US005229826A

United States Patent [19]

Sonnenberg

[11] Patent Number: 5,229,826

[45] Date of Patent: Jul. 20, 1993

[54] TONER CLEANING APPARATUS

[75] Inventor: Sven Sonnenberg, Rochester, N.Y.

[73] Assignee: Eastman Kodak Company, Rochester, N.Y.

[21] Appl. No.: 787,291

[22] Filed: Nov. 4, 1991

[51] Int. Cl.[5] ..... G03G 21/00

[52] U.S. Cl. ..... 355/298; 355/296

[58] Field of Search ..... 355/296, 298, 297, 299, 355/304, 260; 15/256.51, 256.52; 118/652

[56] References Cited

U.S. PATENT DOCUMENTS

| | | | |
|---|---|---|---|
| 4,140,388 | 2/1979 | Ikesue et al. | 355/298 |
| 4,218,132 | 8/1980 | Iwai et al. | 355/299 |
| 4,284,345 | 8/1981 | Sugiyama et al. | 355/299 |
| 4,297,026 | 10/1981 | Honda et al. | 355/299 |
| 4,357,098 | 11/1982 | Endo | 355/299 |
| 4,530,594 | 7/1985 | Adachi | 355/299 |
| 4,561,766 | 12/1985 | Fox | 355/215 |
| 4,593,997 | 6/1986 | Fox et al. | 355/298 |
| 4,685,798 | 8/1987 | Matsumoto | 355/299 |
| 4,766,457 | 8/1988 | Barker et al. | 355/260 |
| 4,888,620 | 12/1989 | Fujino et al. | 355/211 |
| 4,931,840 | 6/1990 | Tanzawa et al. | 355/298 |
| 4,947,216 | 8/1990 | Surti | 355/299 |

FOREIGN PATENT DOCUMENTS

| | | | |
|---|---|---|---|
| 0130079 | 8/1982 | Japan | 355/298 |
| 0286083 | 12/1983 | Japan | 355/298 |
| 0095486 | 4/1988 | Japan | 355/298 |

*Primary Examiner*—A. T. Grimley
*Assistant Examiner*—Christopher Horgan
*Attorney, Agent, or Firm*—David A. Howley

[57] ABSTRACT

An apparatus for cleaning toner from a surface includes a scraper blade that removes toner particles from the surface. A storing container is provided for holding the removed toner particles. The toner particles are guided away from the surface by a guide member. The guide member is movable toward the storing container to move the removed toner particles to the storing container. In a preferred embodiment of the invention, the removed toner particles are compacted by the guide member. A cleaning implement is utilized to remove toner particles from the compacting member.

10 Claims, 2 Drawing Sheets

TONER CLEANING APPARATUS

TECHNICAL FIELD OF THE INVENTION

The present invention relates to apparatus for cleaning toner from a surface. Although not limited thereto, it is particularly usable in cleaning residual toner from an image-forming surface in a copier, printer or similar apparatus.

BACKGROUND OF THE INVENTION

U.S. Pat. No. 4,685,798, issued in the name of Matsumoto on Aug. 11, 1987, shows a scraper blade in contact with the surface of a photoreceptive drum and a container for storing toner stripped from the surface of the photoreceptive drum by the scraper blade. A conveyor member moves the stripped toner away from the drum and into the storage container.

A problem with this cleaning apparatus is that it is complex. The conveyor member is actually made up of two members joined at a pivot. A spring is used to urge the two members to rotate about the pivot in a complex pattern. A simpler apparatus is desired.

A further problem with the above cleaning apparatus is that stripped toner will build up near the photoreceptive drum. The conveyor member must be operated continuously while the copying machine is in use or else there will be a buildup of residual toner near the photoreceptive drum.

Another problem with this cleaning apparatus is that the residual toner removed from the drum surface is merely moved to a storage container. The residual toner is fluffy (the toner has a very low density) and, therefore, will quickly fill up the available space in the storage container. Either a large storage container will have to be provided or the storage container will have to be emptied at frequent intervals.

SUMMARY OF THE INVENTION

In brief, the present invention provides an apparatus for cleaning toner particles from a surface. Means are included for removing the toner particles from the surface. The removed toner particles are guided away from the surface by guiding means. Storing means are provided for holding the removed toner particles. The guiding means is movable toward the storing means to move the removed toner particles to the storing means.

In a preferred embodiment of the invention, the removed toner particles are compacted by the guiding means, which is comprised of a compacting member. Cleaning means are utilized to dislodge the removed toner particles from the compacting member.

The present invention is simple and easy to operate. Because the removed toner particles are passively guided away from the surface by the compacting member, it is not necessary to constantly rotate the compacting member to move the toner away from the surface. The compacting member need only be rotated periodically, for example at the end of each copying job.

Another advantage of the present invention is that the removed toner particles, which are moved further away from the surface by the compacting member when the compacting member is pivoted away from the surface, are compacted at the same time. This allows a large amount of removed toner particles to be stored in the storing means, comprised of a container, because the ordinarily fluffy toner particles are tightly compacted together. The required frequency of emptying the container will be significantly lessened.

A further advantage is that the use of cleaning means to dislodge removed toner particles from the compacting member assures that removed toner particles will not build up on the compacting member. Such a buildup of toner particles could prevent other removed toner particles scraped from the surface from being moved away from the surface.

The present invention can be used to clean toner particles off any surface in a toner image-forming apparatus, including both front and rear surface of an image-forming member, and a surface of a transfer drum or web.

BRIEF DESCRIPTION OF THE DRAWINGS

The present invention will become more fully understood from the detailed description given hereinbelow and the accompanying drawings which are given by way of illustration only and, thus are not limitative of the present invention and wherein.

DETAILED DESCRIPTION OF THE BEST MODE

Referring to the accompanying drawings, the preferred embodiment of the present invention is described below.

Figure 1:
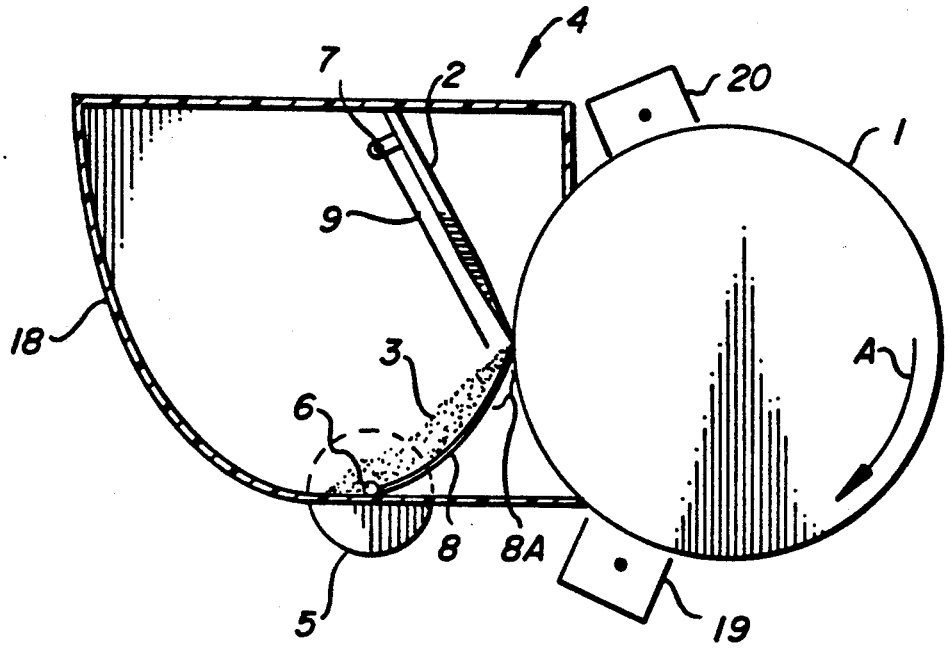
FIG. 1 is a sectional view representing the simplified structural design of a cleaning apparatus embodying the present invention.

Turning now to FIG. 1, a cleaning apparatus, generally designated by the number 4, is installed between a discharge-charger 19 and a charger 20 so that it faces a photoreceptive member, such as photoreceptive drum 1. Cleaning apparatus 4 includes a container 18 located in a position opposite photoreceptive drum 1 and a scraper blade 2, made of an elastic material, that is attached to the upper portion of container 18. A tip of scraper blade 2 comes into contact with the surface of photoreceptive drum 1. This allows scraper blade 2 to slide over the surface of the photoreceptor when the photoreceptive drum moves in a direction shown by arrow A (while the photocopying operation is under way) so that toner particles adhering to the surface of the photoreceptive drum can be removed. Removed toner particles 3 are guided away from the surface of photoreceptive drum 1 by gravity and a compacting member 8. A tip 8*a* of compacting member 8 lightly contacts the surface of the photoreceptive drum at a low angle of attack. Because of the light contact and low angle of attack, tip 8*a* does not remove toner particles from the surface of drum 1. Compacting member 8 is pivotable about a pivot 6 by a solenoid 5. Compacting member 8 may be comprised of any suitable material such as plastic or metal.

A cleaning implement 9 is pivotably attached to scraper blade 2 by a spring-loaded pivot 7. Preferably, implement 9 is made of a flexible plastic. It should be noted that container 18, scraper blade 2, compacting member 8 and cleaning implement 9 are all about the same width as the photoreceptive drum (the width is a dimension that would be measured along an axis perpendicular to the paper on which the FIGS. are located).

Figure 2:
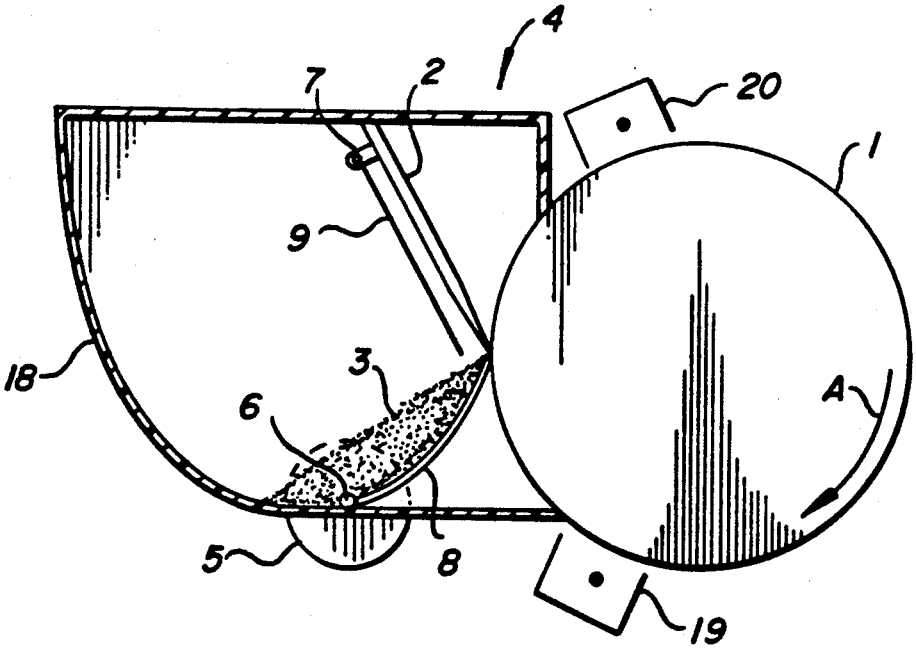
FIG. 2 is a sectional view of a cleaning apparatus, just after a copying job has been completed, embodying the present invention.

Referring to FIG. 2, after a printing job has been completed, the photoreceptive drum will stop rotating. No more toner particles will be scraped from the surface of the drum. Removed toner particles 3, which have been scraped from the surface of drum 1 by the scraper blade, remain on the surface of compacting member 8 and container 18.

Figure 3:
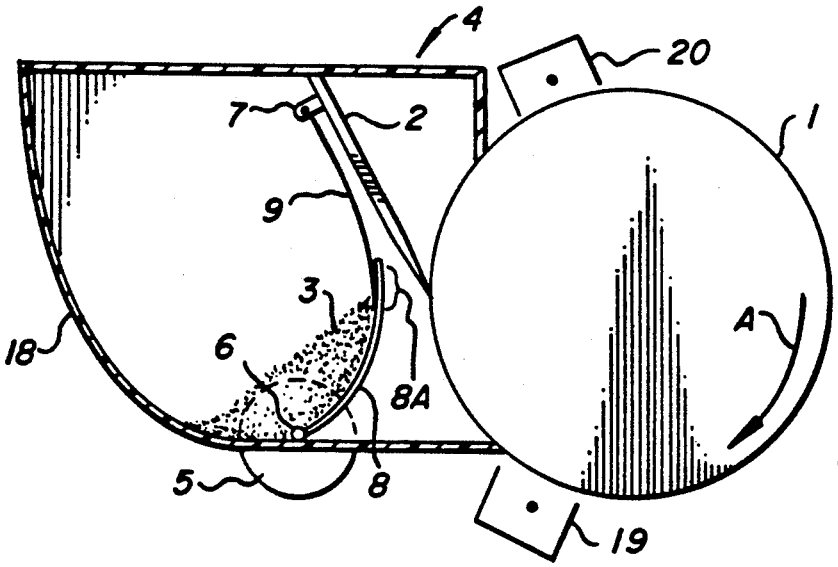
FIG. 3 is a sectional view of a cleaning apparatus embodying the present invention, which is in the process of moving residual toner particles away from a surface.

Turning now to FIG. 3, solenoid 5 has begun to rotate compacting member 8 counter-clockwise about pivot 6. As the compacting member begins to rotate, a tip 9*a* of cleaning implement 9 contacts one side of compacting member 8 at a tip 8*a* of the compacting member. Implement 9 removes toner particles from the compacting member. It is important that tip 8*a* of the compacting member remains free of removed toner particles so that other toner particles scraped from the surface of drum 1 will not be inhibited from moving down the surface of compacting member 8 away from the drum.

Figure 4:
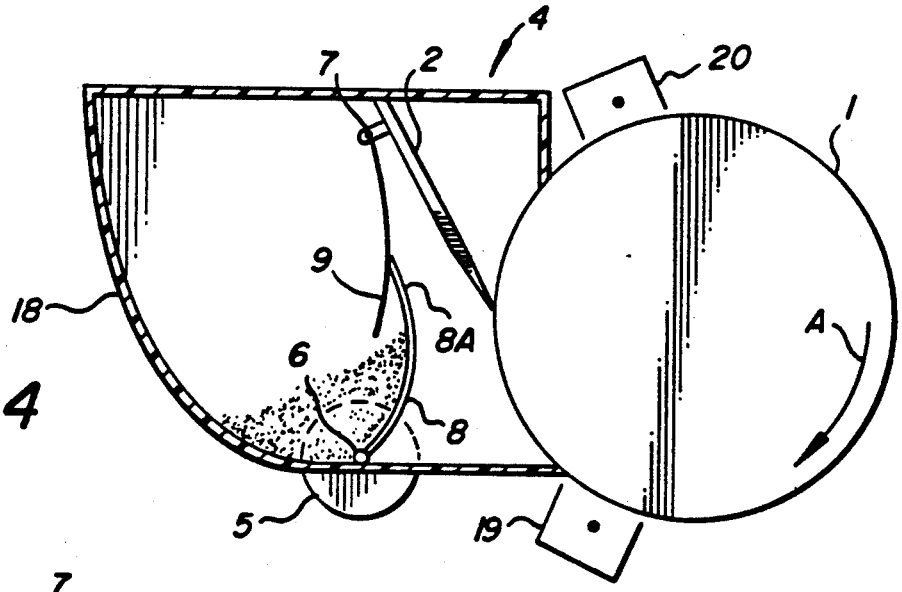
FIG. 4 is a sectional view of a cleaning apparatus embodying the present invention, which is moving residual toner particles still further away from a drum.

Turning now to FIG. 4, solenoid 5 continues to rotate the compacting member in a counter-clockwise motion about pivot 6. Tip 9*a* of cleaning implement 9 no longer engages the surface of compacting member 8. Tip 8*a* of the compacting member is now in contact with the cleaning implement and forces the implement to continue to rotate clockwise about pivot 7.

Figure 5:
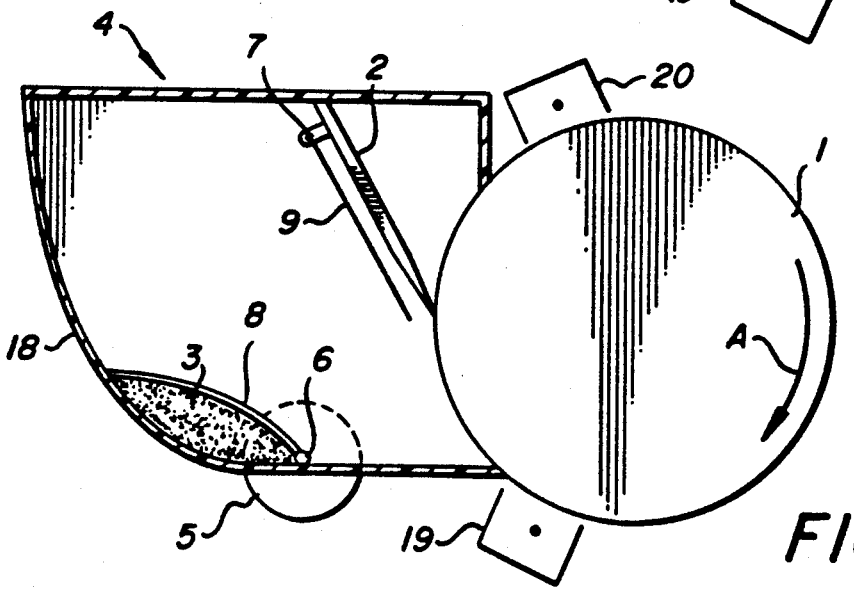
FIG. 5 is a sectional view of a cleaning apparatus embodying the present invention in which residual toner particles are being compacted.

Turning now to FIG. 5, compacting member 8 is shown in its fully rotated position. Removed toner particles 3 have been compacted by compacting member 8 and now occupy a much smaller volume than before. Cleaning implement 9, under the influence of spring-loaded pivot 7 returns to its original position proximate scraper blade 2. After compacting member 8 has been pivoted by the solenoid as far as possible in a counter-clockwise direction, it is rotated clockwise by a solenoid return spring (not shown) to its original position (lightly contacting the surface of drum 1). As compacting member 8 is rotated clockwise, it will momentarily engage cleaning implement 9. Cleaning implement 9 will flex slightly in a counter-clockwise direction, allowing the compacting member to bypass the cleaning implement.

This invention provides a cleaning apparatus in which one part of the apparatus, the compacting member, performs the three functions of passively guiding removed toner particles away from a surface, actively moving these toner particles further away from the photoconductive surface and compacting the toner particles. The fact that one part of the cleaning apparatus performs these numerous functions greatly simplifies the operation of such an apparatus.

The invention has been described in detail with particular reference to a preferred embodiment thereof. However, it will be understood that variations and modifications can be affected within the spirit and scope of the invention.

What is claimed is:

1. Apparatus for cleaning toner from a surface, said apparatus comprising:

means for removing toner particles from the surface;

means for storing the toner particles removed from the surface;

a pivotably mounted member for guiding removed toner particles away from said surface; and means for pivoting said pivotably mounted member, and end of said pivotably mounted member opposite its pivot point being movable between a first position contacting said surface and preventing removed toner particles from escaping said cleaning apparatus, and a second position generally above said storing means where toner can fall into said storing means.

2. An apparatus as defined in claim 1 wherein said pivotably mounted member includes means for compacting removed toner particles.

3. An apparatus as defined in claim 1 wherein said pivotably mounted member is periodically movable from said first position to said second position and back to said first position.

4. An apparatus as defined in claim 1 further comprising cleaning means, said cleaning means being positioned such that when said pivotably mounted member is pivoted away from said surface, said cleaning means will contact a side of said pivotably mounted member which guides said removed toner particles away from said surface, dislodging toner particles from said pivotably mounted member.

5. An apparatus as defined in claim 4 wherein said cleaning means comprises a cleaning implement comprised of plastic.

6. An apparatus as defined in claim 5 wherein said means for removing toner particles comprises a scraper blade in contact with said surface.

7. An apparatus as defined in claim 6 wherein said plastic cleaning implement is secured to said scraper blade.

8. An apparatus as claimed in claim 1 wherein said surface is the surface of a photoreceptive member.

9. Apparatus for cleaning toner from a surface, which surface is movable in a first direction, said apparatus comprising:

a scraper blade positioned against said surface to remove toner carried by the surface;

a guide blade having a free end contacting said surface upstream of the scraper blade and positioned to prevent toner removed from the surface by the scraper blade from escaping the cleaning apparatus, said guide blade being pivotable about a pivot remote from said free end;

means for storing the toner removed from the surface; and means for pivoting the guide blade around said pivot to move the free end of said guide blade toward said storing means to move removed toner to said storing means.

10. Apparatus as defined in claim 9 in which said pivoting means includes means for pivoting said free end sufficiently into said storing means to compact said toner.

* * * * *